United States Patent [19]

Forster

[11] Patent Number: 4,534,271

[45] Date of Patent: Aug. 13, 1985

[54] DUAL MACHINE AGGREGATES WITH A CONNECTION FOR A CONSUMER OF MECHANICAL ENERGY

[75] Inventor: Franz Forster, Muhlbach, Fed. Rep. of Germany

[73] Assignee: Linde Aktiengesellschaft, Wiesbaden, Fed. Rep. of Germany

[21] Appl. No.: 508,793

[22] Filed: Jun. 29, 1983

[30] Foreign Application Priority Data

Jul. 7, 1982 [DE] Fed. Rep. of Germany ..... 3225464

[51] Int. Cl.[3] ..... F01B 13/04; F04B 23/04

[52] U.S. Cl. ..... 91/472; 91/499; 417/269; 417/426

[58] Field of Search ..... 91/486, 499, 500, 501, 91/503, 504, 505, 506, 507, 472; 417/269, 203, 206, 236–238, 426, 429, 199 R, 313; 74/60, 15.84; 92/12.2; 60/488, 489, 486

[56] References Cited

U.S. PATENT DOCUMENTS

| | | | |
|---|---|---|---|
| 2,168,669 | 8/1939 | Ernst | 417/199 R |
| 2,452,704 | 11/1948 | Wahlmark | 91/506 X |
| 2,910,008 | 10/1959 | Weisenbach | 417/429 X |
| 3,065,602 | 11/1962 | Curlett | 60/486 X |
| 3,123,975 | 3/1964 | Ebert | 60/486 X |
| 3,148,628 | 9/1964 | Boydell | 91/506 |
| 3,286,464 | 11/1966 | Dowty | 60/488 |
| 3,523,491 | 8/1970 | Howell | 92/12.2 |
| 3,548,715 | 12/1970 | Bobst | 91/499 X |
| 3,597,115 | 8/1971 | Jass et al. | 417/313 |
| 3,996,841 | 12/1976 | Gostomski, Jr. | 91/499 |
| 4,004,863 | 1/1977 | Porel | 417/319 X |

FOREIGN PATENT DOCUMENTS

| | | | |
|---|---|---|---|
| 548273 | 9/1956 | Italy | 91/500 |
| 220417 | 8/1924 | United Kingdom | 91/505 |

*Primary Examiner*—William L. Freeh
*Assistant Examiner*—Paul F. Neils
*Attorney, Agent, or Firm*—Buell, Ziesenheim, Beck & Alstadt

[57] ABSTRACT

A two-machine aggregate, preferably a dual-pump aggregate, with two swash plate axial piston pumps arranged coaxially to each other back-to-back is provided, where an auxiliary shaft is provided for the purpose of offering a connection and attachment possibility for at least one additional pump, which shaft runs parallel to the coaxial shafts of the two machines of the two-machine aggregate and is driven by means of a torque transfer unit, in which case the auxiliary shaft and the torque transfer unit are located in an intermediate component which extends between the two machines of the two-machine aggregate and projects above them.

14 Claims, 6 Drawing Figures

DUAL MACHINE AGGREGATES WITH A CONNECTION FOR A CONSUMER OF MECHANICAL ENERGY

This invention relates to dual machine aggregates with a connection for a consumer of mechanical energy and more particularly to a two machine aggregate of two hydrostatic piston machines arranged coaxially to each other, preferably piston pumps, in particular, axial piston pumps in the swash plate design, with a free shaft connection for connecting an additional consumer of mechanical energy. However, the invention can be used not only for two-pump aggregates, but also in two-machine aggregates consisting of a pump and a hydrostatic piston motor, which are interlocked to form a hydrostatic drive and are located in a common housing, in which case an overall housing resulting from the solid or detachable connection of the housings of the individual machines with each other can be understood to be the common housing. The flanging of two pumps with their housing in series one behind the other or the flanging of the two pumps to each other so that the two control bottom sides are facing each other (back-to-back arrangement) is known in two-pump aggregates consisting of two axial piston pumps in swash plate form. The flanging of additional pumps to the possible free shaft connection coaxial to the two pumps, in both arrangements of two pumps at the end of the second pump, is known in both cases. A rather long aggregate thus results, especially if several additional pumps are to be flanged on. However, the space required is frequently not available for such a long aggregate, especially if such an aggregate is also to be flanged coaxially to an internal combustion engine. Furthermore, the center of gravity of the overall aggregate is quite far from the principal flange in such a long aggregate, i.e., the flange with which it is connected to the driving engine, such that the principal flange is very heavily loaded. For various purposes, e.g., dredge drives, it is now necessary to drive several additional pumps and possibly other consumers of mechanical energy, such as air compressors or electric generators. For this purpose, the imposition of a distributor transmission between the driving primary energy source and the two-pump aggregate and its connection at the transmission housing along with the other consumers of mechanical energy are also know. However, this is a very expensive design which also necessitates either very many gears or gears with a very large diameter and thus a high peripheral speed for bridging the axial distances required.

The invention proposes an arrangement for the free shaft connection that does not increase the length of the construction, together with a tolerable construction cost. It also proposes the possibility of connecting more than one additional consumer of mechanical energy, e.g., more than one pump.

This is solved in accordance with the invention in that the free shaft connection is formed on a auxiliary shaft that is arranged parallel to the mutually coaxial shafts of the two machines, preferably pumps, along the two machines, preferably pumps, in which case a torque transfer unit, which is connected with the auxiliary shaft, is connected with the shaft between the two machines, preferably pumps.

According to a preferred embodiment, the torque transfer unit and the auxiliary shaft are located in an intermediate component that is interposed between the two machines, preferably pumps. This intermediate component can be provided for flanging on additional pumps or other consumers of mechanical energy. On the other hand, this intermediate component can expediently contain the channels that feed the fluid to the pumps and remove it from them.

The expression "an auxiliary shaft" is to be considered an auxiliary shaft at least in the sense of the invention, that is, in a two-machine aggregate the inventive concept can be used repeatedly. For this purpose, several auxiliary shafts can be arranged in the intermediate component parallel to each other at such a distance from each other and from the housing of the principal machines that additional consumers can be connected to each, in which case the torque transfer unit must be appropriately designed, e.g., a chain drive must be guided over several sprocket gears arranged on an auxiliary shaft, so that a corresponding branching results inside of the intermediate component, or a separate torque transfer unit must be provided for each auxiliary shaft. The intermediate component is expediently designed so that the auxiliary shaft has a free connection on each side and the intermediate component is advantageously designed with a housing to which the additional consumers of mechanical energy, e.g., additional pumps, can be flanged directly. A particularly advantageous embodiment results if the auxiliary shaft is designed as a hollow shaft that is supported in the intermediate component on both sides of the torque transfer unit and is designed so that the free shaft ends of the additional pumps can be shoved directly into the hollow auxiliary shaft. It is particularly advantageous here if the hollow auxiliary shaft and free shaft ends of the additional pumps have torque transfer means that directly match each other, such as a splined shaft or toothed profile.

The torque transfer unit can be a traction unit drive such as a toothed belt or a roller chain or it can be a gear drive, where a gear drive is preferably designed as a spur gear drive with an intermediate gear.

The statement that the auxiliary shaft is located alongside the common shafts or the coaxial shafts of the two machines does not mean that it is alongside in the same horizontal plane, but it can also be above or preferably below the main shafts.

In a two-pump aggregate in which the two pumps coaxial to each other are arranged to face each other with their control bottom side and each pump has a free shaft end with a torque synchronization device, e.g., a splining, a particularly expedient implementation according to the invention results if the torque transfer unit is supported on the two shaft ends, e.g., is designed as a gear or sprocket wheel with a hollow shaft, in which case this hollow shaft is shoved onto the two free shaft ends with the torque synchronization device, so that this torque transfer unit serves not only to transfer the torque to the auxiliary shaft or shafts, but also for transfering the torque from the pump flanged directly to the primary energy source to the second principal pump. This means that the inlet member of the torque transfer unit is designed as a clutch that connects the shafts of the two principal machines with each other.

If the torque transfer unit is a gear that is in operating connection with another gear on the auxiliary shaft, preferably through at least one intermediate gear in the intermediate component, a particularly advantageous additional implementation possibility results, through the fact that the gear on the auxiliary shaft and the gear engaging with it and/or another gear pair of the torque transfer unit can be designed as a gear pump. This gear pump can serve, for example, to such the housing of the two principal pumps coaxial to each other dry.

According to an expedient additional embodiment of the invention, an additional gear pump, preferably a gear pump designed as an internal toothed ring pump, is located as an additional pump on the auxiliary shaft directly in the housing of the intermediate component or directly on it. This can, for example, serve to produce a control oil stream required for actuating the servo power amplification control units, and/or in a two-pump aggregate in which the two pumps operate in an oil-free housing, this additional pump can serve, at least as an auxiliary function, to provide lubricant to the bearings of the main pumps.

If the two main pumps are swash plate pumps, the axes of the inclination of the swash plates can be parallel to each other or be displaced by 180° or 90° with respect to each other. Depending on the choice of this arrangement, the suction sides in both pumps are on the same side or the suction sides are on opposite sides and the delivery sides respectively or the suction sides and the delivery sides are displaced by 90° with respect to each other. The later arrangement facilitates an extremely short extension in the axial direction because all four channels can be brought together very well. In most cases multipump aggregates are designed, however, so that they operate in open circuit and in this case it is advantageous if a common suction channel can be provided for both pumps. Up to four auxiliary pumps are now required in dredge drives, in which case an additional pump can operate as a rotary pump, primarily at higher drive capacities.

Through the arrangement of the auxiliary shaft according to the invention it is possible to connect other auxiliary pumps on both sides of this auxiliary shaft, where in most cases the space available is designed so that the same construction length is available for the auxiliary pumps as for a main pump, so that it is thus possible to flange several auxiliary pumps to each other on each side of the intermediate component.

In the foregoing general description I have set out certain objects, purposes and advantages of this invention. Other objects, purposes and advantages of the invention will be apparent from a consideration of the following description and the accompanying drawings in which.

Figure 1:
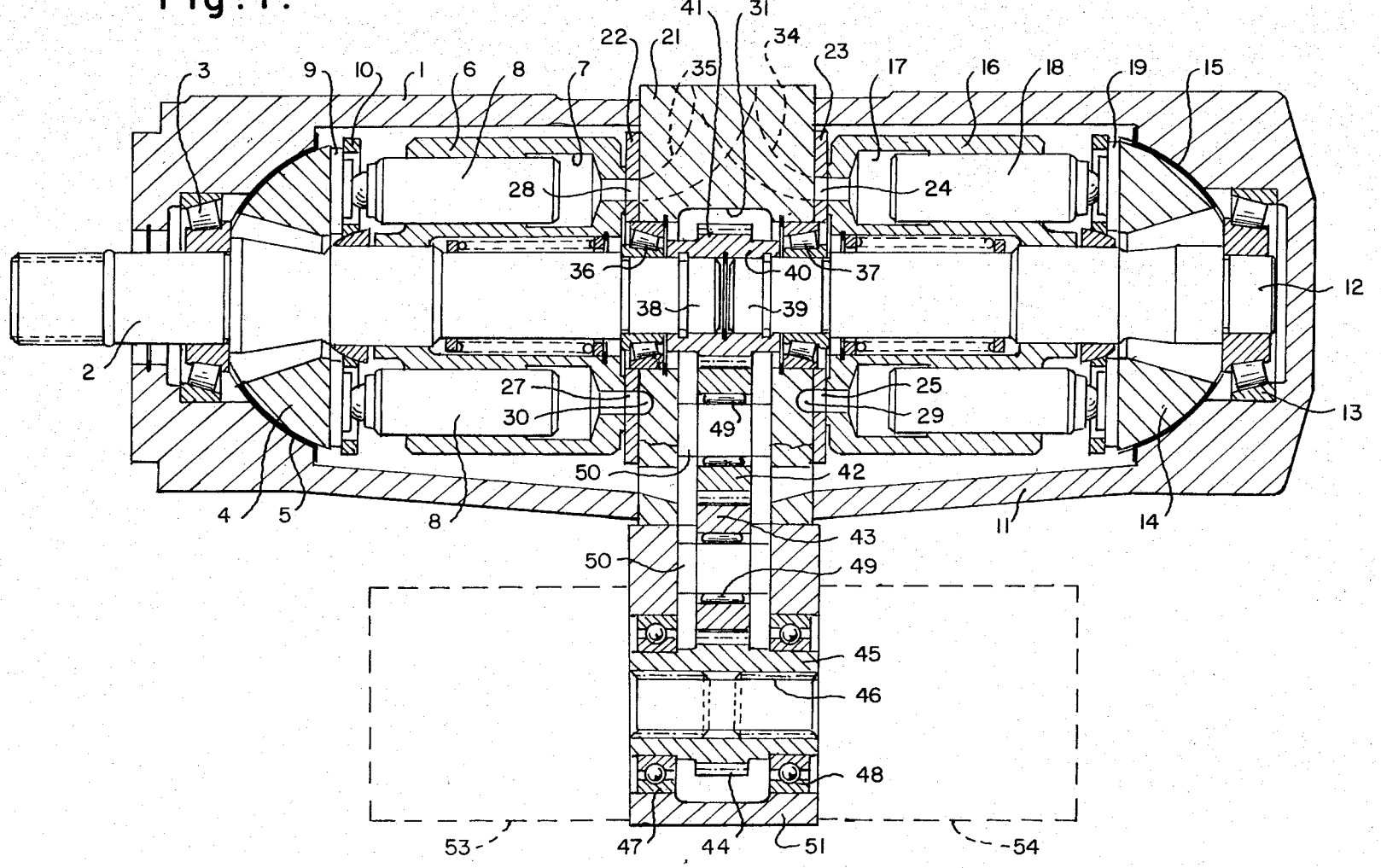
FIG. 1 shows an axial section through a two-pump aggregate in which the torque transfer unit according to the invention is designed as a rack and pinion drive.

An adjustable swash plate axial piston pump is located in the housing 1; its shaft 2 is supported in the housing 1 by means of a roller bearing 3 and its swash plate rocker 4 is also supported in the housing 1 by means of a bearing box 5. The cylinder drum 6, in which cylinders 7 are provided, is connected in a rotatably fixed manner with the shaft 2, in which case a piston 8 is capable of moving in each cylinder 7 and it rests against the swash plate surface formed on the swash plate rocker 4 through a slide shoe 9. The retaining plate 10 assures that the slide shoes 9 do not rise from the swash plate surface. The swash plate pump 1–10 is the first main pump of the two-pump aggregate, the second pump of which is located in the housing 11 and is correspondingly constructed, with the difference that the shaft 2 has a free end for connection with the primary energy source, while the shaft 12 of the second pump has no free end. The housing 11 is also correspondingly closed in the axial direction. In addition, roller bearing 13 corresponds to roller bearing 3, the swash plate rocker 14 to swash plate rocker 4, cylinder drum 16 to cylinder drum 6, cylinder 17 to cylinder 7, piston 18 to piston 8, slide shoe 19 to slide shoe 9, and bearing box 15 to bearing box 5.

The housings 1 and 11 are connected with the intermediate housing 21 by means of bolts (not shown) and with it form a common housing for the first main pump 1–10 and the second main pump 11–19.

Two approximately semicircular channels 24–25 and 27–28 are formed in each of the two control plates 22 and 23. The semicircular channel 25 lies precisely opposite a semicircular channel 29 in the intermediate housing and the semicircular channel 27 accordingly lies opposite a semicircular channel 30 in the intermediate housing 21, in which case the two channels 29 and 30 inside of the intermediate housing 21 outside of the region in the latter in which the recess 31 is formed are converged to a channel 32, which leads to a suction flange in the side wall of the intermediate housing 21. Correspondingly, the semicircular channels 24 and 28 are located opposite semicircular channels in the intermediate housing 21, in which case the channel 34 correspondingly emptying into the semicircular channel 24 leads to a flange connection in the side wall of the intermediate housing 21. The intermediate housing 21 also contains a channel 35, the one mouth of which precisely matches the semicircular channel 28 in the control plate 22, while the other mouth leads to a connection flange in the same lateral surface of the intermediate housing 21, in which the channel 34 also empties. The channels 34 and 35 are not however connected with each other. Rather, channel 34 is the delivery channel of the second main pump and channel 35 is the delivery channel of the first main pump. In FIG. 1 the channels 24–32 and 34,35 are shown turned by 90° in the plane of the drawing. Actually, the separating web lies in the plane of the drawing.

Shaft 2 is supported in the intermediate housing 21 by means of a roller bearing 36 and shaft 12 is supported in the intermediate housing 21 by means of a roller bearing 37. The shaft 2 has a splined free end 38 and shaft 12 has a splined free end 39, in which case the splines of these two shaft ends 38 and 39 are inserted into a corresponding spline of the hollow shaft 40, which is the hub of a gear 41. Besides the spline, a cylindrical key is located on each side of the hollow shaft 40, with which the latter (40) is supported on the free shaft end 38 and 39 with a suitably closer tolerance.

The gear 41 engages with an intermediate gear 42, which in turn engages with an intermediate gear 43, which engages with a gear 44, the hub 45 of which is in turn designed as a hollow shaft, in which case this hollow shaft 45 forms the auxiliary shaft that is provided with an internal spline 46. The hollow shaft 45 is supported in the auxiliary housing 51 by means of roller bearings 47 and 48. This housing 51 is solidly connected with the intermediate housing 21 in a manner not shown in the drawing and with it forms an intermediate component 21, 51. The gears 42 and 43 are each supported on a journal pin 50 by means of a roller bearing 49; this journal pin 50 is in turn fastened in the intermediate housing 21 or the auxiliary housing 51. The auxiliary housing 51 is designed so that an auxiliary pump 53 (indicated by dashed lines) can be flanged on the end face (on the left in the FIG. 1) and an auxiliary pump 54 (also shown by dashed lines) can be connected to the end face (on the right in FIG. 1) of the auxiliary housing 52, in which case the free shaft end of the two auxiliary pumps 53 and 54 is inserted into the hollow shaft 45 or its spline 46.

Through the arrangement of the intermediate component 21, 51 the possiblity of connecting the two auxiliary pumps 53 and 54 is thus provided, without requiring more space in the axial extension than is necessary for the two main pumps 1–10 and 11–19, since an intermediate housing, in which the channels 32, 34, 35 are located, is required between the housings 1 and 11 in any case.

Figure 2:
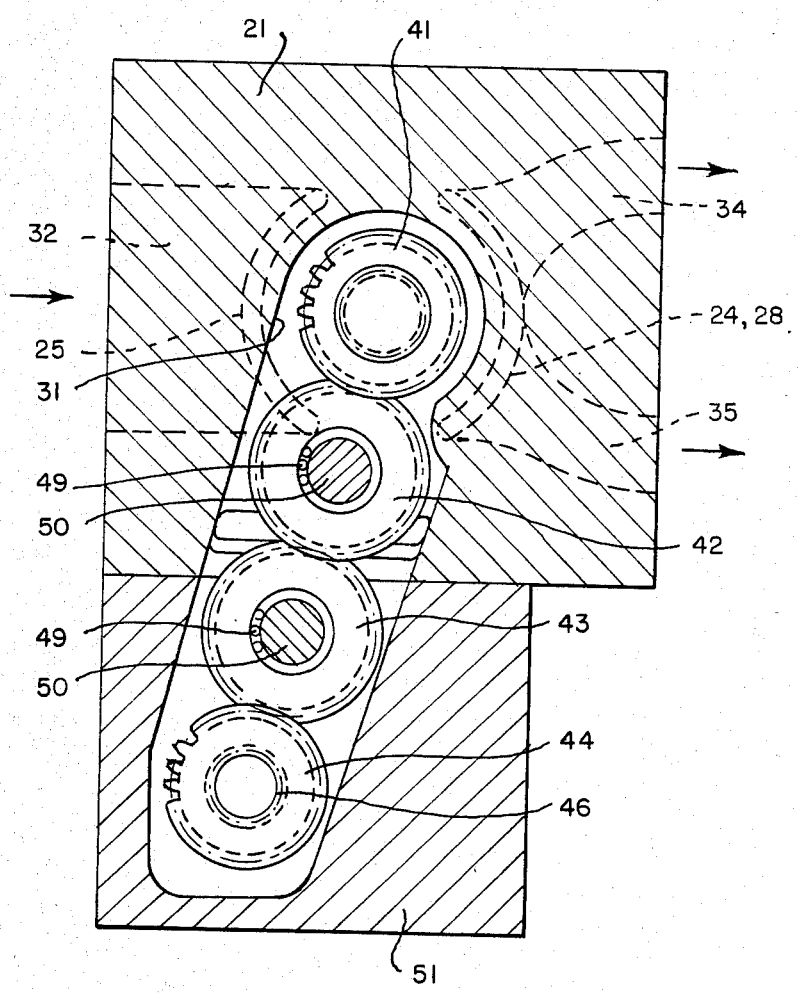
FIG. 2 shows a section through an aggregate according to FIG. 1, perpendicular to the axis of rotation.
Figure 3:
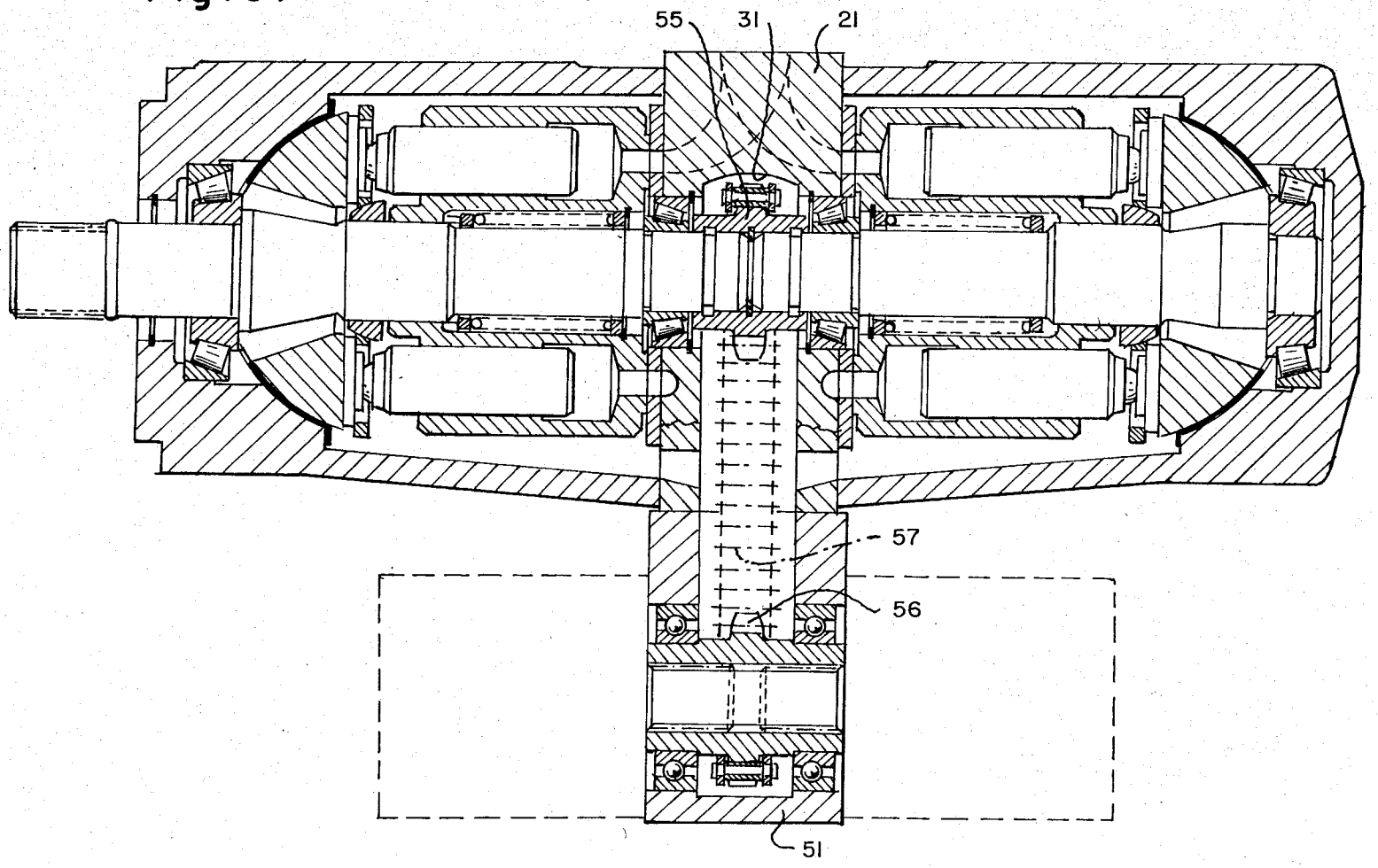
FIG. 3 shows a two-pump aggregate in which the torque transfer unit according to the invention is a roller chain drive.
Figure 4:
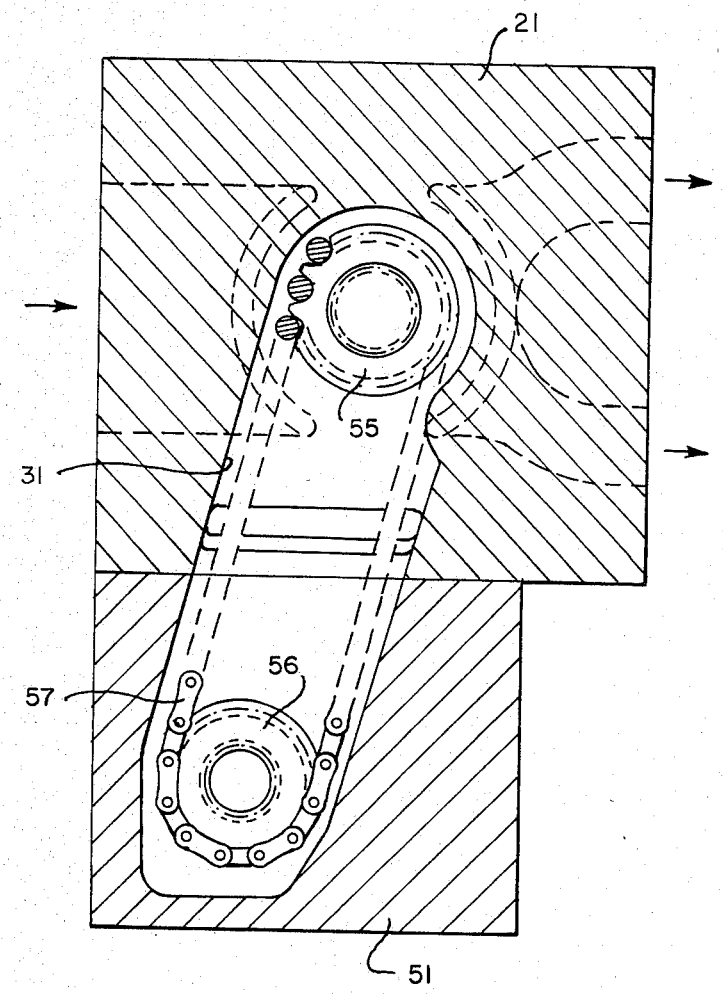
FIG. 4 shows a section perpendicular to the axis on the Line IV—IV of FIG. 3.

The embodiment according to FIGS. 3 and 4 differs from that of FIGS. 1 and 2 only in that there is a sprocket wheel 55 instead of the gear 41 and a sprocket wheel 56 instead of the gear 44, in which case these two sprocket wheels 55 and 56 are operatively connected by means of a chain 57 and jointly form a torque transfer unit, which in this case is again located in the recess 31. In addition to a chain and sprocket type traction element drive as just described one might also use a toothed belt and sprocket or gear form of traction element drive.

Figure 5:
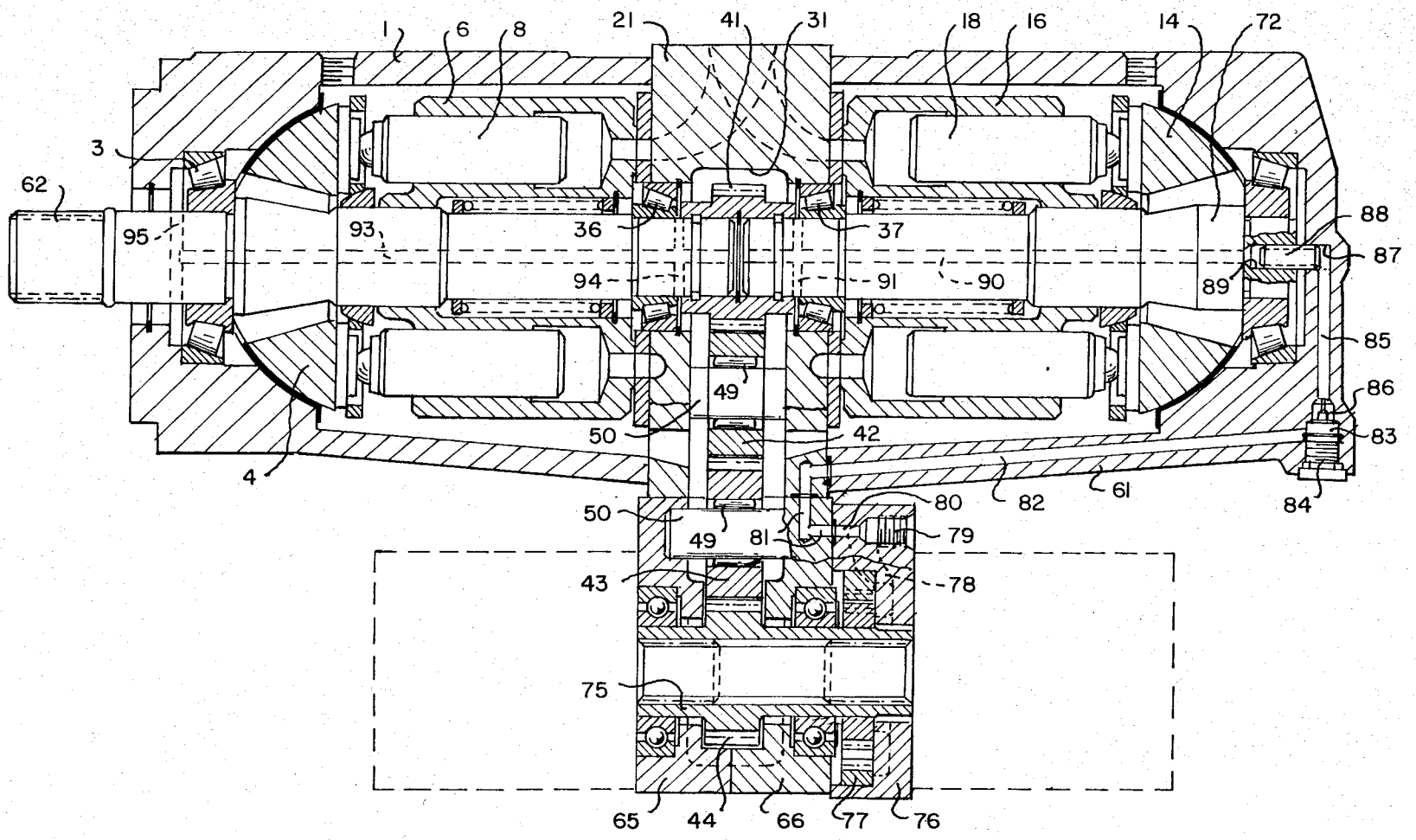
FIGS. 5 and 6 show a further refinement of the embodiment shown in FIGS. 1 and 2.
Figure 6:
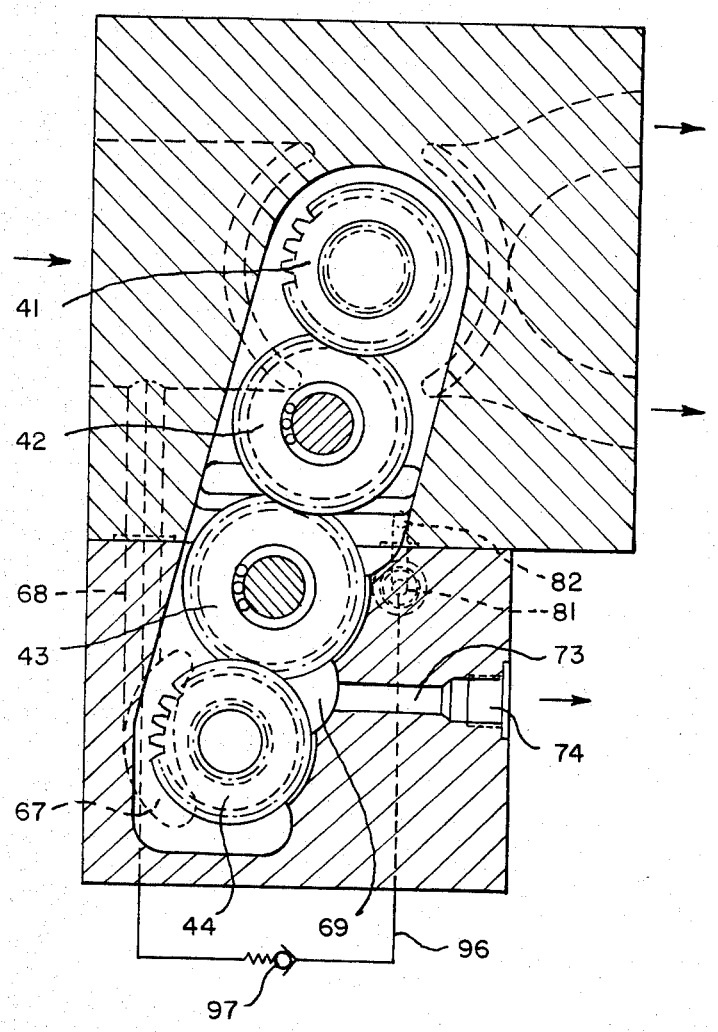

The embodiment according to FIGS. 5 and 6 differs from the implementation according to FIGS. 1 and 2 in two respects.

On the one hand, there is shaft 62 instead of shaft 2 and shaft 72 instead of shaft 12 and housing 61 instead of housing 11, in which case shaft 62 differs from shaft 2 in that boreholes are provided in shaft 62 for lubricant transport; likewise, shaft 72 differs from shaft 12 by boreholes for lubricant transport and housing 61 differs from housing 11 also through boreholes for lubricant transport.

Furthermore, the embodiment according to FIGS. 5 and 6 differs from that according to FIGS. 1 and 2 in that instead of the auxiliary housing 51 there is an auxiliary housing that consists of two auxiliary housing sections 65 and 66 and, together with the gears 44 and 43 and the channels in the auxiliary housing 65, 66, forms a gear pump that serves to draw leakage oil out of the inner space of the housing 1 and 61. A suction channel 68, 67 is provided for this purpose, where the channel 68 is connected with the inner spaces of the housing 1 and 61, which are joined together through the inner space of the intermediate housing 21. On the other side, the recess 69 is connected with a borehole 73, which leads to a connection flange 74, to which a line that leads to an oil supply reservoir can be connected. Even if the line connected to the connection 74 empties below the fluid level in the oil reservoir, all the leakage oil can be sucked out of the inner space of the housing 1, 61 through the action of the gear pump 44, 43, such that there is no turbulence of oil during movement of the cylinder drums 6 and 16 and the slide shoes 9 and 19.

The embodiment according to FIGS. 5 and 6 differs from that according to FIGS. 1 and 2 also in that instead of the hollow shaft 45 there is a hollow shaft 75 and a toothed ring pump housing 76 is flanged on the right-hand side (in FIG. 5) of the auxiliary housing 65, 66; in this housing 76 there is a toothed ring pump 77 that delivers into a channel 78. A connection 79 is connected to the channel 78 and a line leading to a pickup of a hydraulic remote control, for example, can be connected to it. Furthermore, a channel 80 also departs from the channel 78 and continues in a channel 81 in the auxiliary housing section 66, which in turn is connected to a channel 82 in the housing 61 of the second main pump. This channel 82 communicates with a borehole 83, which is closed by a stopper 84 and continues coaxially in a borehole 85, in the inlet of which a feed restrictor 86 is incorporated. The borehole 85 empties into a borehole 87, into which a tube 88 is solidly pressed. This tube 88 projects with a slight play into a borehole 89 in the shaft 72, which continues in a borehole 90, from which transverse boreholes 91 depart for lubrication of the roller bearing 37. A central borehole 93 is also provided in the shaft 62, in which case the two boreholes 90 and 93 empty in the end faces of the shafts 62 and 72 so that the fluid lubricant can flow from the borehole 90 into the borehole 93. Radial boreholes 94 for lubricating the roller bearing 36 branch off from the borehole 93, and radial boreholes 95, which serve to lubricate the roller bearing 3, branch off from it.

FIG. 6 indicates merely schematically a line 96 that connects the borehole 81 with the channel 68. A pressure-limiting valve 97 is located in the line 96; it protects the channels 78, 81 and possibly the line connected to the connection 79 against inadmissibly high pressure.

In the foregoing specification I have set out certain preferred practices and embodiments of this invention, however, it will be understood that this invention may be otherwise embodied within the scope of the following claims.

I claim:

1. In a two-machine aggregate with two hydrostatic piston machines arranged coaxially to each other with a common intermediate control bottom between them, having a common shaft, a free shaft connection for connecting another consumer of mechanical energy spaced from said common shaft, the improvement comprising a torque transfer unit connected with the said common shaft between the two machines and extending through the common intermediate control bottom, the free shaft connection being located on an auxiliary shaft parallel to said common shaft of the two machines and said torque transfer unit being connected with this auxiliary shaft.

2. A two-machine aggregate according to claim 1 wherein said common shaft is formed of two shafts, one for each machine of the aggregate connected together between said machines.

3. A two-machine aggregate according to claim 1 or 2, wherein the two machines are pumps.

4. A two-machine aggregate according to claim 1 or 2, wherein the torque transfer unit is a traction element drive.

5. A two-machine aggregate according to claim 1 or 2, wherein the auxiliary shaft is a hollow shaft.

6. A two-machine aggregate according to claim 1 or 2 having an additional pump located on the auxiliary shaft.

7. A two-machine aggregate according to claim 1 or 2, wherein the torque transfer unit is a gear drive.

8. A two-machine aggregate according to claim 7, having a first gear on the auxliary shaft and at least one intermediate gear engaging said first gear, wherein the gear on the auxliary shaft and the intermediate gear engaging with it form a gear pump.

9. In a two-machine aggregate with two hydrostatic piston machines arranged coaxially to each other, having a common shaft, a free shaft connection for connecting another consumer of mechanical energy, the improvement comprising a torque transfer unit connected with the common shaft between the two machines, the free shaft connection being located on an auxiliary shaft parallel to said common shaft of the two machines and said torque transfer unit being connected with this auxiliary shaft, said common shaft being formed of two shafts, one for each machine of the aggregate connected together between said machines, wherein the two machines are swash plate pumps each having a control bottom side on a common intermediate component and the torque transfer unit is located in this intermediate component.

10. A two-machine aggregate according to claim 9, wherein the intermediate component is provided with flange means for flanging on additional energy consumers.

11. In a two-machine aggregate with two hydrostatic piston machines arranged coaxially to each other with a common intermediate control bottom between them, having a common shaft, a free shaft connection for connecting another consumer of mechanical energy, the improvement comprising a torque transfer unit connected with the common shaft between the two machines, the free shaft connection being located on an auxiliary shaft parallel to said common shaft of the two machines and said torque transfer unit extending through the common intermediate control bottom being connected with this auxiliary shaft, said common shaft being formed of two shafts, one for each machine of the aggregate connected together between said machines, said machines being pumps, each pump having a free shaft end provided with a torque synchronization device on its control bottom side, said torque transfer unit having a drive member supported on the two shaft ends of the pumps and connecting them.

12. In a two-machine aggregate with two hydrostatic piston machines arranged coaxially to each other, having a common shaft, a free shaft connection for connecting another consumer of mechanical energy, the improvement comprising a torque transfer unit connected with the common shaft between the two machines, the free shaft connection being located on an auxiliary shaft parallel to said common shaft of the two machines and said torque transfer unit being connected with this auxiliary shaft, an additional pump located on the auxiliary shaft and wherein the gears of the torque transfer unit form a pump which is connected with a housing of the several machines for drawing oil out from inside said housing on the suction side and an additional pump is provided at least as an auxiliary function for forcing lubricant to bearings on the shafts.

13. A two-machine aggregate according to claim 12 wherein said common shaft is formed of two shafts, one for each machine of the aggregate connected together between said machines.

14. In a two-machine aggregate with two hydrostatic piston machines arranged coaxially to each other, having a common shaft, a free shaft connection for connecting another consumer of mechanical energy, the improvement comprising a torque transfer unit connected with the common shaft between the two machines, the free shaft connection being located on an auxiliary shaft parallel to said common shaft of the two machines and said torque transfer unit being connected with this auxiliary shaft and being a gear drive, having a first gear on the auxiliary shaft and at least one intermediate gear engaging said first gear, wherein the gear on the auxiliary shaft and the intermediate gear engaging with it form a gear pump, said pump being connected with a housing of the several machines for drawing oil out from inside said housing on the suction side and an additional pump provided on the auxiliary shaft at least as an auxiliary function for forcing lubricant to the bearings on the shafts.

* * * * *